US009668626B2

(12) United States Patent
Kim et al.

(10) Patent No.: US 9,668,626 B2
(45) Date of Patent: Jun. 6, 2017

(54) NOZZLE FOR A VACUUM CLEANER AND VACUUM CLEANER

(71) Applicant: LG ELECTRONICS INC., Seoul (KR)

(72) Inventors: Seongjun Kim, Seoul (KR); Jinwoo Lee, Seoul (KR); Seogyong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/965,358

(22) Filed: Dec. 10, 2015

(65) Prior Publication Data

US 2016/0174790 A1 Jun. 23, 2016

(30) Foreign Application Priority Data

Dec. 10, 2014 (KR) ..... 10-2014-0177726

(51) Int. Cl.
*A47L 9/04* (2006.01)
*A47L 9/02* (2006.01)

(52) U.S. Cl.
CPC ..... *A47L 9/02* (2013.01); *A47L 9/04* (2013.01); *A47L 9/0427* (2013.01); *A47L 9/0433* (2013.01); *A47L 9/0444* (2013.01); *A47L 9/0455* (2013.01)

(58) Field of Classification Search
CPC ..... A47L 9/02; A47L 9/0455; A47L 9/0444; A47L 9/0427; A47L 9/0433; A47L 9/04; A47L 9/068; A47L 9/0477
See application file for complete search history.

(56) References Cited

FOREIGN PATENT DOCUMENTS

| | | | |
|---|---|---|---|
| GB | 2 407 259 | A | 4/2005 |
| JP | S51-125463 | U | 10/1976 |
| JP | 2010-124845 | | 6/2010 |
| KR | 10-0232561 | | 12/1999 |
| KR | 10-2009-0121813 | | 11/2009 |

OTHER PUBLICATIONS

European Search Report issued in related Application No. 15198317.8 dated May 3, 2016.

*Primary Examiner* — David Redding
(74) *Attorney, Agent, or Firm* — KED & Associates, LLP

(57) ABSTRACT

A nozzle for a vacuum cleaner and a vacuum cleaner are provided. The nozzle may include a main nozzle; at least one movable nozzle rotatably coupled to the main nozzle; and a rotary cleaner provided inside of the main nozzle and the movable nozzle that cleans a floor surface using a rotary motion. The rotary cleaner may include a main shaft rotatably provided inside of the main nozzle, and at least one auxiliary shaft provided inside of the movable nozzle and connected to the main shaft. The at least one auxiliary shaft may rotate using a rotational force transmitted from the main shaft.

12 Claims, 7 Drawing Sheets

NOZZLE FOR A VACUUM CLEANER AND VACUUM CLEANER

CROSS-REFERENCE TO RELATED APPLICATION(S)

The present application claims priority under 35 U.S.C. §119 and 35 U.S.C. §365 to Korean Patent Application No. 10-2014-0177726 filed on Dec. 10, 2014, which is hereby incorporated by reference in its entirety.

BACKGROUND

1. Field

A nozzle for a vacuum cleaner and a vacuum cleaner are disclosed herein.

2. Background

Vacuum cleaners are apparatuses that suck up air including dust using a suction force generated by a suction motor installed inside of a main body, and filter the dust in a dust separation unit or device. Vacuum cleaners may be classified into canister type cleaners, in which a suction nozzle configured to suction dust is provided separately from a main body and connected to the main body by a connection device, and upright type cleaners, in which a suction nozzle is rotatably connected to a main body. A nozzle for a cleaner was disclosed in Korean Patent Publication No. 10-2009-0121813, a related art document, which is hereby incorporated by reference in its entirety.

The nozzle of a vacuum cleaner may include a main nozzle, in which a main suction port may be formed, and an auxiliary nozzle, which may be selectively accommodated in the main nozzle and in which an auxiliary suction port may be formed. In addition, the main nozzle may include an agitator. According to such a nozzle for a vacuum cleaner, as an entire suction area may increase in a state in which the auxiliary nozzle is drawn out of the main nozzle, a possible cleaning area may increase; however, there may be a problem in that floor cleaning may not be performed at a portion in which the agitator corresponds to the auxiliary nozzle of the suction port.

BRIEF DESCRIPTION OF THE DRAWINGS

Embodiments will be described in detail with reference to the following drawings in which like reference numerals refer to like elements, and wherein.

DETAILED DESCRIPTION

Reference will now be made to embodiments, examples of which are illustrated in the accompanying drawings. In the following detailed description of embodiments, reference is made to the accompanying drawings that form a part hereof, and in which is shown by way of illustration embodiments which may be practiced. These embodiments are described in sufficient detail to enable those skilled in the art to practice the embodiments, and it is understood that other embodiments may be utilized and that logical structural, mechanical, electrical, and chemical changes may be made without departing from the spirit or scope of the disclosure. To avoid detail not necessary to enable those skilled in the art to practice the embodiments, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
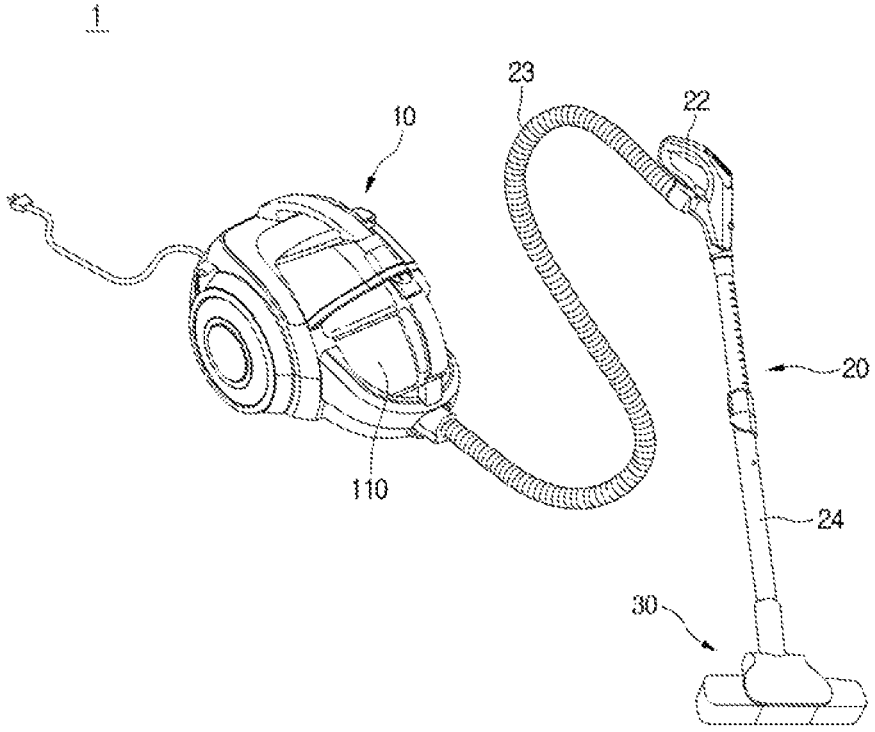
FIG. 1 is a perspective view illustrating a vacuum cleaner according to an embodiment.

FIG. 1 is a perspective view of a vacuum cleaner according to an embodiment. Even though a canister type cleaner is illustrated in FIG. 1, alternatively, a suction nozzle according to an embodiment may be applied to an upright type cleaner. In addition, the term "floor surface" used herein may refer to not only a hard floor surface, of a living room, but also a soft surface, such as carpet, for example.

Referring to FIG. 1, a vacuum cleaner 1 according to an embodiment may include a cleaner main body 10 having a suction motor (not shown) configured to generate a suction force, and a suction unit or device 20, which may be connected to the cleaner main body 10 and may be configured to suction air and foreign material from a floor surface. The cleaner main body 10 may include one or more wheels and a dust container 110, in which dust separated from the air may be stored. The suction device 20 may include a suction nozzle 30 capable of moving along a floor surface, and a connection unit or device configured to connect the suction nozzle 30 and the cleaner main body 10. The connection unit may include an extension pipe 24 connected to the suction nozzle 30, a handle 22 connected to the extension pipe 24, and a connection hose 23, which may connect the handle 22 to the cleaner main body 10.

Figure 2:
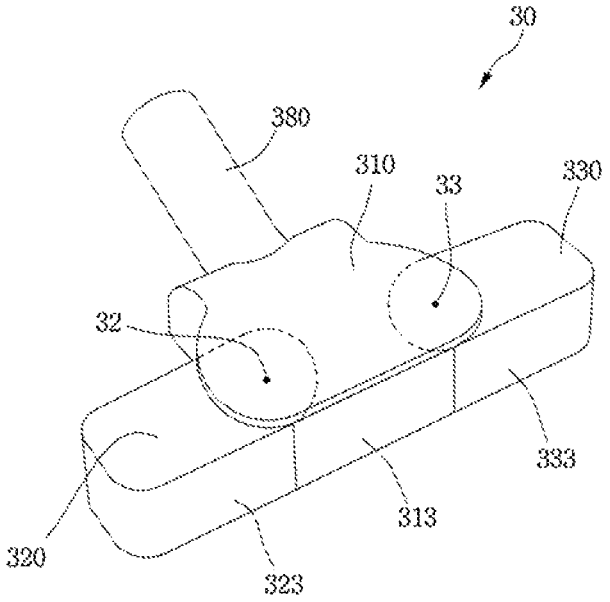
FIG. 2 is a view of a suction nozzle of the vacuum cleaner of FIG. 1.
Figure 3:
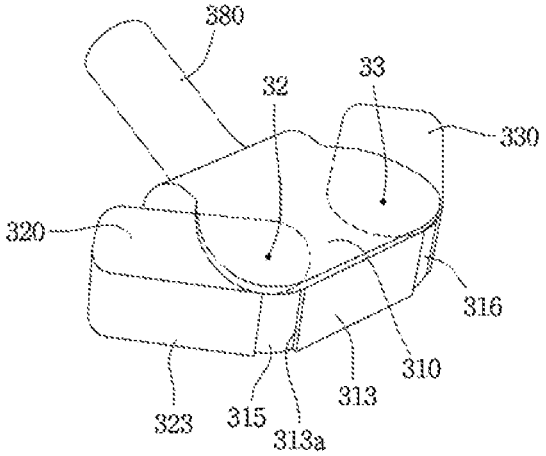
FIG. 3 is a view illustrating a state in which a movable nozzle of the suction nozzle of FIG. 2 is bent.
Figure 4:
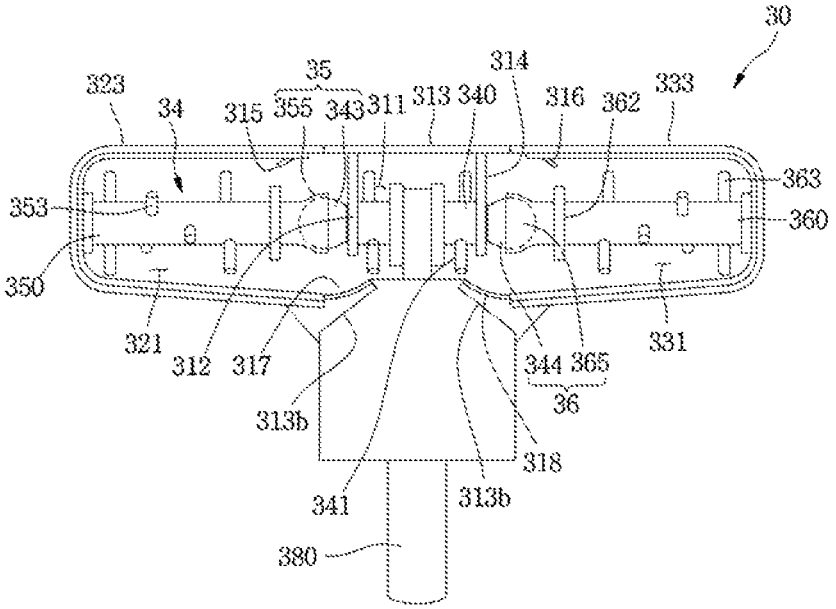
FIG. 4 is a bottom view of the suction nozzle of FIG. 2.
Figure 5:
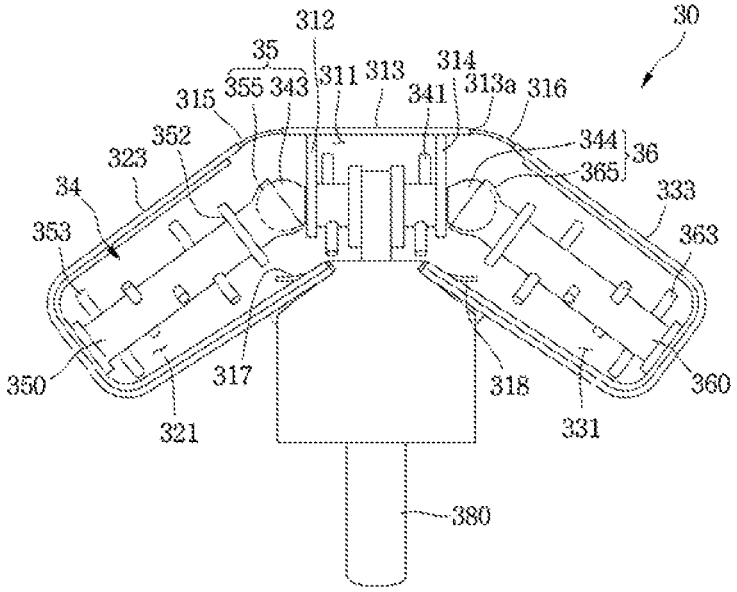
FIG. 5 is a bottom view illustrating the suction nozzle which shows a state in which the movable nozzle shown in FIG. 3 is bent.

Hereinafter, the suction nozzle 30 will be described. FIG. 2 is a view illustrating a suction nozzle of the vacuum cleaner of FIG. 1. FIG. 3 is a view illustrating a state in which a movable nozzle of the suction nozzle of FIG. 2 is bent. FIG. 4 is a bottom view of the suction nozzle of FIG. 2. FIG. 5 is a bottom view illustrating the suction nozzle which shows a state in which the movable nozzle shown in FIG. 3 is bent.

Referring to FIGS. 2 to 5, the suction nozzle 30 may include a main nozzle 310, and one or more movable nozzles 320, 330 movably connected to the main nozzle 310. A main suction port 311 may be formed in the main nozzle 310, and foreign material suctioned through the main suction port 311 may move to the dust container 110 of the cleaner main body 10 through the extension pipe 24.

The one or more movable nozzles 320, 330 may be rotatably connected to the main nozzle 310 within a predetermined angle range. The one or more movable nozzles 320, 330 may rotate around rotation axes 32, 33, which may be included in the one or more movable nozzles 320, 330 or the main nozzle 310. Accordingly, a user may manually bend or rotate at least one of the one or more movable nozzles 320, 330 by gripping the at least one of the one or more movable nozzles 320, 330. For example, even though two movable nozzles 320, 330 connected to both ends of the main nozzle 310 are illustrated in FIG. 2, the number of movable nozzles 320, 330 according to an embodiment may not be limited to the number illustrated.

The movable nozzles 320, 330 may include a first movable nozzle 320 rotatably connected to a first side of the main nozzle 310, and a second movable nozzle 330 rotatably connected to a second side of the main nozzle 310. The movable nozzles 320, 330 may respectively include auxiliary suction ports 321, 331. Structures of the first movable nozzle 320 and the second movable nozzle 330 may be the same; however, lengths of the first movable nozzle 320 and the second movable nozzle 330 may be the same or different from each other.

The first movable nozzle 320 and the second movable nozzle 330 may be independently rotated with respect to the main nozzle 310. That is, one of the first movable nozzle 320 or the second movable nozzle 330 may be rotated to have a predetermined angle with respect to the main nozzle 310. In addition, the first movable nozzle 320 and the second movable nozzle 330 may also be simultaneously rotated with respect to the main nozzle 310. A predetermined rotation range of the first movable nozzle 320 with respect to the main nozzle 310 and a predetermined rotation range of the second movable nozzle 330 with respect to the main nozzle 310 may be different.

Rotation angles of the first movable nozzle 320 and the second movable nozzle 330 may be limited to within the predetermined range by first stoppers 313*a* and second stoppers 313*b* provided in a main body 313 of the main nozzle 310. That is, a first directional rotation of the first movable nozzle 320 and the second movable nozzle 330 may be limited when auxiliary bodies 323, 333, which may respectively form exteriors of the first movable nozzle 320 and the second movable nozzle 330, contact the first stoppers 313*a* of the main body 313 when the auxiliary bodies 323, 333 rotate in the first direction. In addition, a second directional rotation of the first movable nozzle 320 and the second movable nozzle 330 may be limited when the auxiliary bodies 323, 333 contact the second stoppers 313*b* of the main body 313 when the auxiliary bodies 323, 333 rotate in the second direction.

When the auxiliary bodies 323, 333 contact the first stoppers 313*a* of the main body 313, the main body 313 and the auxiliary bodies 323, 333 may be linearly arranged. On the contrary, when the auxiliary bodies 323, 333 contact the second stoppers 313*b* of the main body 313, the main body 313 may be provided at a predetermined oblique angle with respect to the auxiliary bodies 323, 333. As the first movable nozzle 320 or the second movable nozzle 330 is bent or rotated, a gap between the main body 313 and the auxiliary body 323 or 333 may be formed. When the gap is formed, a suction force may be dispersed and the suction force of the main suction port 311 may be reduced. In order to prevent this, the main nozzle 310 may further include front seals 315, 316 to seal the gap. The front seals 315, 316 may be interposed between the main body 313 and the auxiliary bodies 323, 333, and may be included in the main body 313. The front seals 315, 316 may include a plate, which may have at least one side formed in a curved shape.

When the auxiliary bodies 323, 333 are separated from the first stoppers 313*a* of the main body 313, the front seals 315, 316 may be exposed to the outside. That is, when the auxiliary bodies 323, 333 are separated from the first stoppers 313*a*, the front seals 315, 316 may prevent a gap from being generated between the first stopper 313*a* and the auxiliary bodies 323, 333.

Similar to the above, a gap may also be generated at a rear of the main nozzle 310 according to a rotation angle of the first movable nozzle 320 or the second movable nozzle 330. The main nozzle 310 may further include rear seals 317, 318 to seal the gap formed at the rear thereof. The rear seals 317, 318 may include a plate, which may have at least one side formed in a curved shape.

When the auxiliary bodies 323, 333 are separated from the second stoppers 313*b* of the main body 313, the rear seals 317, 318 may be exposed to the outside. That is, when the auxiliary bodies 323, 333 are separated from the second stoppers 313*b*, the rear seals 317, 318 may prevent gaps from being generated between the second stoppers 313*b* and the auxiliary bodies 323, 333.

In addition, the suction nozzle 30 may further include a connection pipe 380 rotatably connected to a rear side of the main nozzle 310. The extension pipe 24 may be connected to the connection pipe 380. The suction nozzle 30 may further include a rotary cleaning unit or cleaner 34. The rotary cleaner 34 may be rotatably installed inside of the suction nozzle 30. The rotary cleaner 34 may include a rotation portion, or main shaft 340, to which a force may be transmitted from a separate drive source which will be described hereinafter, and one or more auxiliary cleaning portions or auxiliary shafts 350, 360, which may rotate using the force transmitted from the rotation portion 340.

A number of the auxiliary cleaning portions 350, 360 may be equal to a number of movable nozzles 320, 330. For example, in FIG. 4, it is illustrated that two auxiliary cleaning portions 350, 360 may be connected to the rotation portion 340. The one or more auxiliary cleaning portions 350, 360 may include a first auxiliary cleaning portion 350 connected to a first side of the rotation portion 340, and a second auxiliary cleaning portion 360 connected to a second side of the rotation portion 340.

The rotary cleaner 34 may include a plurality of brushes 341, 353, and 363 configured to clean a floor surface. The plurality of brushes 341, 353, and 363 may brush up the foreign material from the floor surface and clean the floor surface using a rotary motion of the rotary cleaner 34. The plurality of brushes 341, 353, and 363 may be included in each of the rotation portion 340 and the one or more auxiliary cleaning portions 350, 360.

The rotation portion 340 may also include brush 341. In this case, the rotation portion 340 may also serve as a cleaning portion. When the rotation portion 340 serves as the cleaning portion, the rotation portion 340 provided at the main nozzle 310 may be a main cleaning portion 340.

The rotary cleaner 34 may further include joints 35, 36, which may connect the one or more auxiliary cleaning portions 350, 360 and the rotation portion 340. The joints 35, 36 may include a constant velocity joint. The joints 35, 36 may include a first joint 35, which may connect the first auxiliary cleaning portion 350 and the rotation portion 340, and a second joint 36, which may connect the second auxiliary cleaning portion 360 and the rotation portion 340.

The first joint 35 may include a first head 343, which may be provided at a first side end of the rotation portion 340, and a first accommodation portion 355, which may be provided at one side end of the first auxiliary cleaning portion 350 and into which the first head 343 may be inserted. Similar to the above, the second joint 36 may include a second head 344, which may be provided at a second side end of the rotation portion 340, and a second accommodation portion 365, which may be provided at one side end of the second auxiliary cleaning portion 360 and into which the second head 344 may be inserted. The heads 343, 344 may vertically and horizontally rotate freely in a state in which the heads 343, 344 are respectively inserted into the accommodation portions 355, 365.

As the constant velocity joint used herein may be a known structure, description thereof has been omitted. However, in this embodiment, as the constant velocity joint is provided, even though the movable nozzles 320, 330 may rotate and the auxiliary cleaning portions 350, 360 may be bent or rotate, the auxiliary cleaning portions 350, 360 may rotate with the rotation portion 340.

When the auxiliary cleaning portions 350, 360 and the rotation portion 340 are linearly disposed, the joints 35, 36 may rotate the auxiliary cleaning portions 350, 360 using a rotational force transmitted from the rotation portion 340, and additionally, even when the auxiliary cleaning portions 350, 360 are bent or rotate with respect to the rotation portion 340 to have a predetermined angle, the joints 35, 36 may transmit the rotational force of the rotation portion 340 to the auxiliary cleaning portions 350, 360. The joints 35, 36 may transmit the rotational force so that the auxiliary cleaning portions 350, 360 may rotate at a same angular velocity as an angular velocity of the rotation portion 340.

The main nozzle 310 may further include first supports 312, 314 configured to support the rotation portion 340. The first supports 312, 314 may be provided in the main body 313. The rotation portion 340 may pass through the first supports 312, 314, and may be rotatably supported by the first supports 312, 314.

The movable nozzles 320, 330 may further include second supports 352, 362, which may be respectively provided in the auxiliary bodies 323, 333, and may be configured to respectively support the auxiliary cleaning portions 350, 360. The auxiliary cleaning portions 350, 360 may respectively pass through the second supports 352, 362, and may be rotatably supported respectively by the second supports 352, 362.

Figure 6:
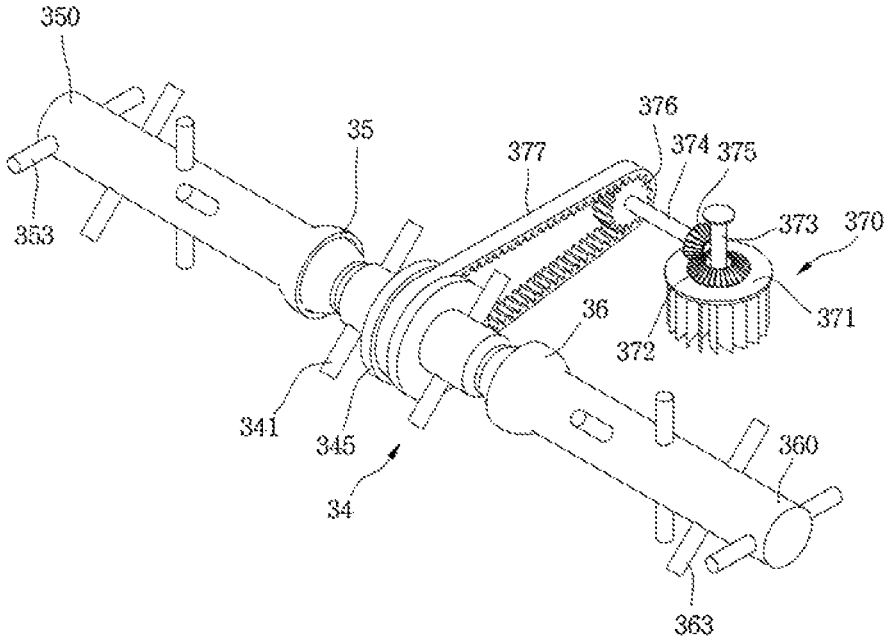
FIG. 6 is a perspective view illustrating a rotary cleaner and a drive configured to drive the same according to an embodiment.

FIG. 6 is a perspective view of a rotary cleaner and a drive configured to drive the same according to an embodiment. Referring to FIG. 6, the suction nozzle 30 may further include a drive 370 configured to drive the rotary cleaner 34.

The drive 370 may include a rotation drive 371. For example, the rotation drive 371 may include a turbine having a plurality of blades. The rotation drive 371 may be rotated by air introduced inside of the suction nozzle 30.

The drive 370 may include a supporting shaft 373, which may be provided in the rotation drive 371 and configured to rotatably connect the rotation drive 371 to the suction nozzle 30. For example, the supporting shaft 373 may be installed in the main nozzle 310.

The drive 370 may further include gears 372, 375 configured to transmit a force of the rotation drive 371 to the rotary cleaner 34. The gears 372, 375 may include a first gear 372 provided in the rotation drive 371, and a second gear 375 connected to the first gear 372. Each of the first gear 372 and the second gear 375 may include a bevel gear. The drive 370 may further include a rotary shaft 374. The second gear 375 may be provided at a first side of the rotary shaft 374, a pulley 376 may be provided at a second side of the rotary shaft, and a belt 377 may loop around the pulley 376.

The rotation portion 340 may include a belt connection portion 345 around which the belt 377 may be looped. The belt connection portion 345 may be provided spaced apart from first and second ends of the rotation portion 340. The first auxiliary rotation portion 350 may be provided at a first side of the belt connection portion 345, and the second auxiliary rotation portion 360 may be provided at a second side of the belt connection portion 345.

A configuration of the rotation portion may not be limited, and a force of the rotation drive 371 may be transmitted to the rotary cleaner 34 in various manners. In addition, a type of the rotation drive 371 may not be limited, and the rotation drive 371 may also include a motor.

Figure 7:
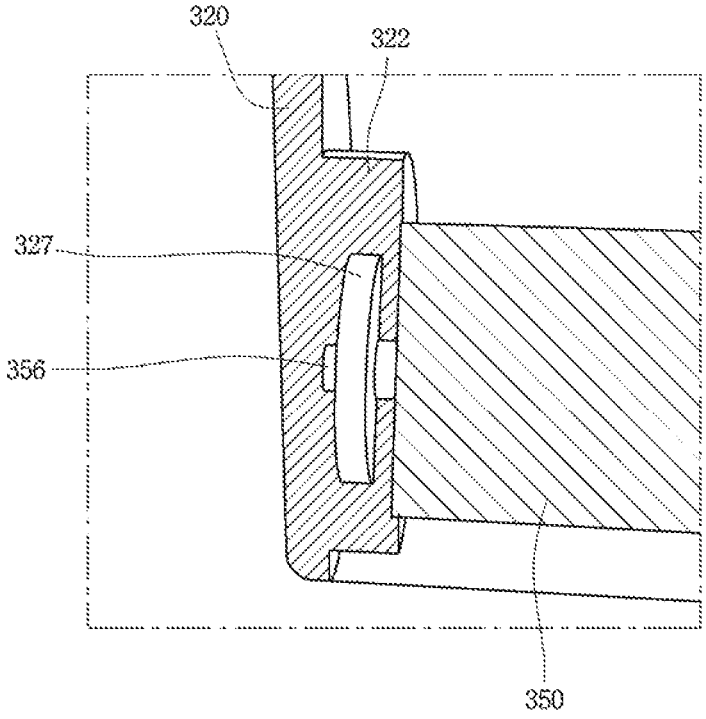
FIG. 7 is a view illustrating a state in which an auxiliary cleaning portion is supported by the movable nozzle according to an embodiment.

FIG. 7 is a view illustrating a state in which an auxiliary cleaning portion according to an embodiment is supported by the movable nozzle according to an embodiment. Referring to FIG. 7, the first movable nozzle 320 may include a bearing 327 connected to a bearing shaft 356 of the first auxiliary cleaning portion 350.

A bearing installation portion 322, in which the bearing 327 may be installed, may be provided at the first movable nozzle 320. When the bearing 327 is installed in the bearing installation portion 322, movement of the bearing 327 in a longitudinal direction or a radial direction of the rotary cleaner 34 with respect to the bearing installation portion 322 may be prevented. Accordingly, the bearing 327 may move with the first movable nozzle 320 by a movement of the first movable nozzle 320. As the bearing 327 may move with the first movable nozzle 320, the first auxiliary cleaning portion 350 having the bearing shaft 356 connected to the bearing 327 may also move.

The second movable nozzle 330 may also include a bearing connected to a bearing shaft of the second auxiliary cleaning portion 360, similar to the first movable nozzle 320. An effect thereof may be the same as that of the first movable nozzle 320 and the first auxiliary cleaning portion 350. That is, the auxiliary cleaning portions 350, 360 may be respectively and rotatably installed in the movable nozzles 320, 330, and may move with the movable nozzles 320, 330. Accordingly, even when the movable nozzles 320, 330 rotate at a predetermined angle with respect to the main nozzle 310, a state in which the auxiliary cleaning portions 350, 360 are respectively connected to the movable nozzles 320, 330 may be maintained. Accordingly, as the auxiliary cleaning portions 350, 360 respectively provided in the movable nozzles 320, 330 may be respectively provided to face the auxiliary suction ports 321, 331 regardless of rotation positions of the movable nozzles 320, 330, a floor surface which faces the auxiliary suction ports 321, 331 may be cleaned.

In the above-described embodiment, even though it is described that the main suction port 311 is formed in the main nozzle 310, alternatively, the main suction port 311 may not be formed in the main nozzle 310. In this case, a brush may also not be provided at the rotation portion 340.

Embodiments disclosed herein provide a nozzle for a cleaner in which a position of a suction port may be changeable, and even though a position of the suction port may be changed, floor cleaning is possible using an entire portion of a suction port, and a vacuum cleaner. Embodiments disclosed herein provide a nozzle for a cleaner that may include a main nozzle; a movable nozzle rotatably provided at the main nozzle; and a rotary cleaning unit or cleaner, which may be provided inside of the main nozzle and the movable nozzle and may clean a floor surface using a rotary motion. The rotary cleaning unit may include a main shaft rotatably provided inside the main nozzle; and an auxiliary shaft provided inside the movable nozzle and connected to the main shaft, and the auxiliary shaft may rotate using a rotational force transmitted from the main shaft.

Embodiments disclosed herein further provide a vacuum cleaner that may include a cleaner main body, which may include a suction motor; and a suction nozzle in communication with the cleaner main body and configured to suction air of a floor surface. The suction nozzle may include a rotary cleaning unit or cleaner, which may clean the floor surface using a rotary motion; a drive unit or drive configured to drive the rotary cleaning unit; a main nozzle, which may cover the rotary cleaning unit; and movable nozzle rotatably provided at the main nozzle and connected to the rotary cleaning unit. The rotary cleaning unit may rotate using a force transmitted from the drive unit regardless of a rotation position of the movable nozzle.

Any reference in this specification to one "embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A nozzle for a vacuum cleaner, comprising:

a main nozzle;

at least one movable nozzle rotatably coupled to the main nozzle; and a rotary cleaner provided inside of the main nozzle and the movable nozzle that cleans a floor surface using a rotary motion, wherein the rotary cleaner includes:

a main shaft rotatably provided inside of the main nozzle; and at least one auxiliary shaft provided inside of the at least one movable nozzle coupled to the main shaft, wherein the at least one auxiliary shaft rotates using a rotational force transmitted from the main shaft, wherein one of the main nozzle or the movable nozzle includes at least one seal configured to seal a gap between the main nozzle and the at least one movable nozzle, and wherein the at least one seal is formed in a curved shape to correspond to the gap between the main nozzle and the at least one movable nozzle.

2. The nozzle of claim 1, wherein, when the at least one movable nozzle rotates to a predetermined angle with respect to the main nozzle, the at least one auxiliary shaft rotates to the same angle.

3. The nozzle of claim 1, wherein at least one of the main shaft or the at least one auxiliary shaft includes at least one brush.

4. The nozzle of claim 1, wherein the rotary cleaner includes a joint that connects the main shaft and a first end of the at least one auxiliary shaft, and wherein the at least one auxiliary shaft is rotated at a same velocity as a velocity of the main shaft by the joint.

5. The nozzle of claim 1, further including:

a head provided on at least one of the at least one auxiliary shaft or the rotation shaft; and an accommodation portion provided on the other of the at least one auxiliary shaft or the rotation shaft, and into which the head is inserted, wherein the head is rotatable inside of the accommodation portion.

6. The nozzle of claim 1, wherein the at least one auxiliary shaft is rotatably coupled to the at least one movable nozzle.

7. The nozzle of claim 1, further including:

a bearing shaft provided at a second end of the at least one auxiliary shaft, and a bearing connected to the bearing shaft, wherein the bearing is provided in the at least one movable nozzle.

8. The nozzle of claim 1, further including:

at least one front seal configured to seal a gap between the main nozzle and the at least one movable nozzle when the movable nozzle rotates in a first direction, and at least one rear seal configured to seal a gap between the main nozzle and the at least one movable nozzle when the at least one movable nozzle rotates in a second direction.

9. The nozzle of claim 1, wherein the main nozzle includes at least one support configured to rotatably support the main shaft.

10. The nozzle of claim 1, wherein the at least one movable nozzle includes at least one support configured to rotatably support the at least one auxiliary shaft.

11. The nozzle of claim 1, further including a main suction port provided in the main nozzle.

12. A vacuum cleaner including the nozzle of claim 1.

* * * * *